United States Patent [19]

Flegal et al.

[11] Patent Number: 4,791,791

[45] Date of Patent: Dec. 20, 1988

[54] CRYOSORPTION SURFACE FOR A CRYOPUMP

[75] Inventors: Christopher M. Flegal, Santa Rosa; John R. Porter, Napa, both of Calif.

[73] Assignee: Varian Associates, Inc., Palo Alto, Calif.

[21] Appl. No.: 146,000

[22] Filed: Jan. 20, 1988

[51] Int. Cl.[4] ..... B01D 8/00

[52] U.S. Cl. ..... 62/55.5; 55/269; 417/901

[58] Field of Search ..... 62/55.5, 268; 55/269; 417/901

[56] References Cited

U.S. PATENT DOCUMENTS

| | | | |
|---|---|---|---|
| 3,387,767 | 6/1968 | Hecht | 62/55.5 |
| 4,121,430 | 10/1978 | Bachler et al. | 62/55.5 |
| 4,295,338 | 10/1981 | Welch | 62/55.5 |
| 4,325,220 | 4/1982 | McFarlin | 62/55.5 |
| 4,336,690 | 6/1982 | Welch | 417/901 |
| 4,479,360 | 10/1984 | Bachler et al. | 62/55.5 |
| 4,530,213 | 7/1985 | Kadi | 62/55.5 |
| 4,546,613 | 10/1985 | Eacobacci et al. | 62/55.5 |
| 4,614,093 | 9/1986 | Bachler et al. | 62/55.5 |
| 4,691,534 | 9/1987 | Lombardini et al. | 62/55.5 |

*Primary Examiner*—Ronald C. Capossela

*Attorney, Agent, or Firm*—Stanley Z. Cole; John C. Yakes

[57] ABSTRACT

A two-stage cryosorption pump has a first stage at a higher temperature and a second stage at a lower temperature. Sorption surfaces of reticulated vitreous carbon formed on the second stage have high rigidity and exceptionally high void volume.

20 Claims, 3 Drawing Sheets

CRYOSORPTION SURFACE FOR A CRYOPUMP

FIELD OF THE INVENTION

This invention pertains generally to a cryogenic pumping apparatus, and more particularly to a two-stage pump using cryosorption in which gases are removed by condensation and absorption on progressively colder pumping surfaces comprising reticulated vitreous carbon.

BACKGROUND OF THE INVENTION

The cryosorption vacuum pump has been known since used as a rough pump by Sir James Dewar and Thomas Edison, circa 1875. This form of usage continues to the present day; e.g., Grant et al., Review of Scientific Instruments, May 1963, pp. 587,588. In recent years there has been a great deal of interest in the usage of cryosorption pumps for the high vacuum range.

Cryosorption pumps, like cryogenic pumps, afford the advantage over ion and diffusion pumps of freedom from electrostatic and magnetic fields and freedom from pump generated hydrocarbons such as methane or pump oil. Cryosorption pumps afford the advantage over cryogenic pumps of trapping high vapor pressure gases such as nitrogen at 77° K. and under high vacuum, hydrogen at 20° K., etc., that would escape a cryogenic pump. Cryosorption pumping elements can be used in separate pump bodies or gas pumping elements in say, an environmental test chamber which may be thought of as a "pump" for purposes of this application.

However, the use of cryosorption in high vacuum pumping requires an effective sorbent mounting arrangement. A cryosorption pumping element must withstand cycling over a substantial temperature range, operating as a pump at 77 or 20 or even 4.2° K. and then baking out at up to 200° C. between pumping cycles to regenerate the sorbent. Proper selection of bond material is necessary to withstand the stress induced by these wide swings of temperature. Good bonding is also necessary to provide effective heat transfer within the pumping element. Other desired properties of cryosorption pumping elements are freedom from organic components such as conventional epoxy binders, ruggedness, economy of manufacture and exposure of substantially all the contained sorbent to the gas to be pumped.

U.S. Pat. No. 3,387,767 to Hecht, assigned in common with the subject patent, discloses the use of a sintered mass of metallic fibers which provide porous holding structure with tunnels leading to absorbent powders within.

Two major disadvantages exist for the granular sorbents, in the prior art, which are bonded to panels. First, the sorbent particles have irregular shapes which prevent uniform, secure bonding. Second, the amount of sorbent which can be bonded with good thermal contact per panel area is limited to one particle layer, which significantly restricts the ultimate volume of gas adsorbed per unit panel area.

OBJECT OF THE INVENTION

It is the object of the invention to provide a new cryosorption pumping element for use in high vacuum pumps which affords compatibility with the high vacuum environment and high pumping speed as well as ruggedness, economy and good bonding of its sorbent.

SUMMARY OF THE INVENTION

This object of the invention and other objects, features and advantages to become apparent as the specification progresses are accomplished by the invention, according to which, briefly stated, the cryosorption pump comprises a vacuum housing in which is located a first stage at a higher temperature and a second stage at a lower temperature with sorption surfaces of reticulated vitreous carbon attached at the second pumping stage.

These and further constructional and operational characteristics of the invention will be more evident from the detailed description given hereinafter with reference to the figures of the accompanying drawings which illustrate preferred embodiments and alternatives by way of non-limiting examples.

DESCRIPTION OF THE PREFERRED EMBODIMENTS

Figure 1:
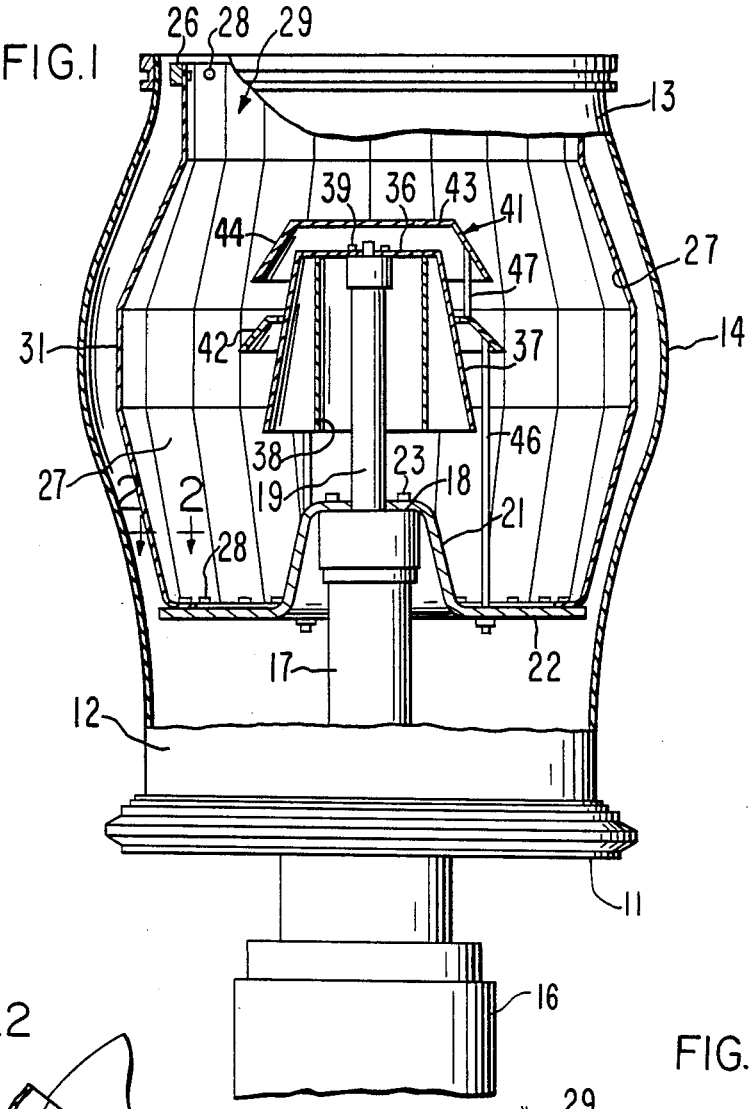
FIG. 1 is a side elevational view, partly broken away and partly schematic, of one embodiment of a cryogenic pump according to the invention.

Referring now to the drawings wherein reference numerals are used to designate parts throughout the various figures thereof, there i shown in FIG. 1 the pump including a generally circular base plate 11 on which a generally cylindrical housing 12 is mounted. The upper end 13 of the housing is open to permit communication with the chamber to be evacuated, and the central portion 14 of the side wall bulges outwardly in the radial direction to permit unrestricted gas flow within the pump.

Cooling is provided by a closed-loop refrigeration system in which compressed helium gas is expanded in two successive stages. This system includes a two-stage expander 16 coupled to a remotely located compressor (not shown). The expander includes an elongated first stage 17 having an annular distal wall 18, and an elongated second stage 19. The first stage is typically maintained at a temperature on the order of 50° K.-80° K., and the second stage is maintained at a temperature on the order of 10° K. -20° K. The expander extends axially through base 11 and is secured thereto by suitable means (not shown).

The first stage of the pump includes a generally circular support plate 21 mounted on expander wall 18, with the outer portion 22 of the plate being offset below the expander wall. The support plate is secured to the expander wall by mounting screws 23 and is in intimate thermal contact with the expander wall. A mounting ring 26 is spaced above the support plate and a plurality of axially extending leaves 27 are arranged circumferentially about the support plate and mounting ring to form a generally cylindrical pumping surface for the first stage. The leaves are secured to the support plate and ring by screws 28 to form a rigid structure, with an inlet opening 29 at the upper end thereof. Leaves 27 are bent to form an outward radial bulge 31 to provide reduction in the restriction to gas flow in the vicinity of the second stage of the pump.

The second stage of the pump includes a radially extending plate 36 mounted on the upper end of expander stage 19, with a depending frustro-conical outer wall 37 and a depending cylindrical inner wall 38. The second stage can be fabricated as a unitary structure and is in intimate thermal contact with the upper wall of the expander, to which it is secured by mounting screws 39. The second stage is positioned coaxially within the first stage.

Means is provided for shielding the second stage of the pump from direct, line-of-sight radiation from the chamber to be evacuated. This means includes an upper baffle member 41 and a lower baffle member 42 spaced axially apart between the first and second stages. Baffle member 41 includes a generally planar central portion 43 positioned between inlet opening 29 and plate 36, with a frustro-conical portion 44 extending downwardly and outwardly beside the upper portion of wall 37. Baffle member 42 comprises a frustro-conical member spaced below baffle member 44, with a larger diameter then the frustro-conical portion of baffle member 44. This spacing is sufficient to provide substantially unimpeded gas flow between the baffle members. The baffle members are maintained at the temperature of tee first stage and are spaced away from the walls of the second stage. The lower baffle member is supported by posts 46 mounted on support plate 21, and the upper baffle member is supported by posts 47 extending between the baffle members.

In this embodiment, the outer surfaces of leaves 27 can be made highly reflective, as by nickel plating, and the inside of pump housing 12 can be electropolished to reduce radiant heat transfer between these bodies. The upper surfaces of baffle members 41, 42 can be also made highly reflective, as by nickel plating, so that radiant energy from external sources will be reflect to the walls of the first stage or out of the pump through the inlet opening. The inner surfaces of leaves 27 can be blackened to prevent external thermal radiation from being reflected to the second stage. The inner surfaces of the second stage (i.e., the lower surface of plate 36, the inner surface of wall 37, and the inner and outer surfaces of wall 38) are preferably coated with reticulated vitreous carbon.

From the foregoing descriptions, it should be obvious to one skilled in the art that all surfaces described as circular or cylindrical can be also formed in a series of connected flat segments, e.g., circular cylinders can be replaced with hexagonal or octagonal cylinders.

Recticulated vitreous carbon is an open pore foam of glassy carbon. This form of carbon combines some of the properties of rigidity and strength of glass with an exceptionally high void volume and the normal chemical advantages of carbon. This material is available from Energy Research and Generation, Inc., Lowell and 57th St., Oakland, Calif. 94608.

Figure 2:
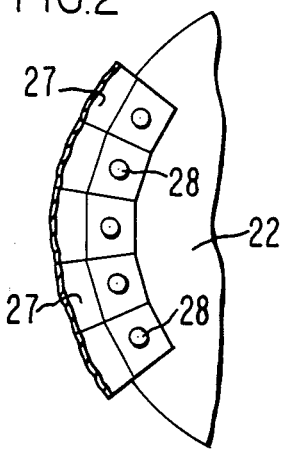
FIG. 2 is a fragmentary cross-sectional view taken along line 2—2 in FIG. 1.
Figure 3:
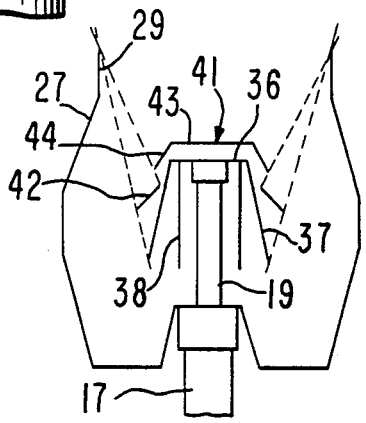
FIG. 3 is a schematic view illustrating the operation of the baffle members in the embodiment of FIG. 1.

Operation and use of the embodiment of FIGS. 1–3 is as follows. A chamber to be evacuated is connected in gaseous communication with inlet opening 29, and the compressor connected to expander 16 is actuated to maintain the first pumping stage at a temperature on the order of 50° K.–80° K. and the second pumping stage at a temperature on the order of 10° K.–20° K. Gases such as water vapor and carbon dioxide condense on the pumping surface formed by the inner walls of leaves 27 on the first pumping stage. Gases such as helium, hydrogen and neon are absorbed on the inner wall surfaces of the second stage, while gases such as oxygen, nitrogen and argon are pumped on all second stage surfaces by condensation. Upper baffle member 41 prevents external thermal radiation from falling on the portion of the second stage above baffle member 42, and baffle member 42 prevents external radiation from reaching the lower portion of the second stage. Being spaced from the second stage and from each other, the baffle members do not interfere appreciably with the flow of gas to the second stage.

Although the first pumping stage and the pump housing are shown as having radially bulging side walls for improved gas flow in the embodiments illustrated, it will be understood that the invention is not limited to this particular wall structure and that the baffle structures disclosed herein can also be employed with straight cylindrical walls or any other suitable wall structure.

Other embodiments of baffles are shown in U.S. Pat. No. 4,336,690, the disclosures of which are hereby incorporated by reference.

Figure 4:
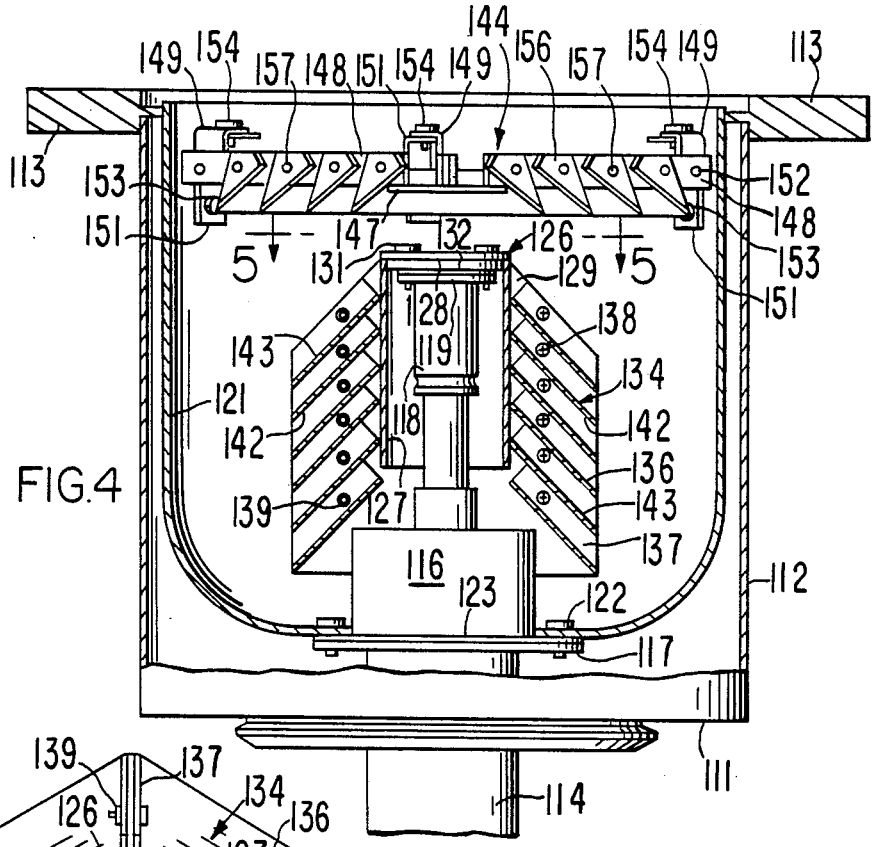
FIG. 4 is a side elevational view, partly broken away and partly schematic, of another embodiment of a cryogenic pumping apparatus according to the invention.
Figure 5:
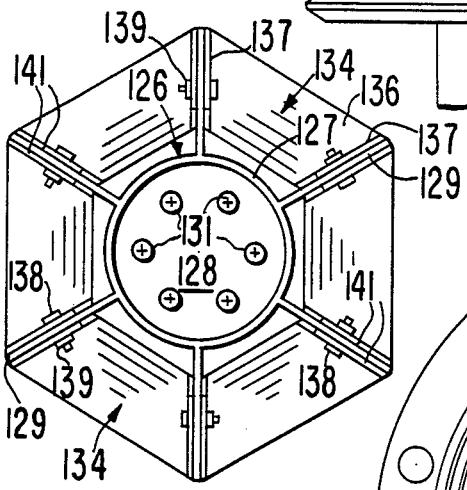
FIG. 5 is an enlarged fragmentary cross sectional view taken along the line 5—5 of FIG. 4.
Figure 6:
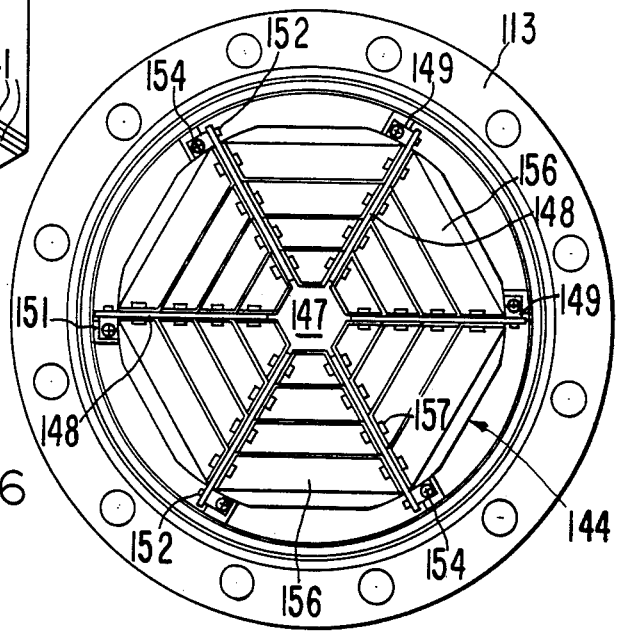
FIG. 6 is a top view of the embodiment of FIG. 4.

A cryogenic vacuum pumping device in another preferred embodiment of the invention is illustrated in FIGS. 4–6. The pumping apparatus includes a generally circular base 111 on which a generally cylindrical housing 112 is mounted. The housing is open at the top with an annular flange 113 for attachment to the mating flange of a port in communication with a chamber to be evacuated.

Cooling is provided by a closed loop refrigeration system in which compressed helium gas is expanded in two successive stages. This system includes a two-stage expander 114 coupled to a remotely located compressor (not shown). The expander includes an elongated first stage 116 having an annular flange 117 toward the upper end thereof and an elongated second stage 118 having a flange 119 toward the upper end thereof. The first stage is typically maintained at a temperature on the order of 50° K. to 80° K., and the second stage is maintained at a temperature on the order of 10° K. to 20° K. The expander extends axially through base 111 and is secured thereto and sealed by suitable means [not shown].

The first stage of the pump includes a generally cup-shaped body 121 mounted on expander flange 117 and secured thereto by mounting screws 122. An indium gasket 123 is employed between the pump body and the expander flange to assure intimate thermal contact between the first stages of the expander and the pump. In one preferred embodiment, pump 121 is fabricated of aluminum conformed to the cup shape by spinning process. The inner surface of pump body 121 is preferably blackened to prevent external thermal radiation from being reflected to the second stage of the pump.

The second stage of the pump includes a frame 126 having an elongated cylindrical core 127 with a circular end plate 128 at the top of the core and a plurality of radial fins 129 extending outwardly and downwardly from the core. In the preferred embodiment, cylindrical coil 127 is fabricated of copper, the radial fins are fabricated of a copper-nickel alloy to provide additional strength, and the core and fins are braced together to form a rigid unitary structure. The frame is mounted on flange 119 at the upper end of the second expander stage and secured thereto by screws 131, with an indium gasket 132 assuring intimate thermal contact between the second stages of the expander and the pump.

The second stage also includes a plurality of individual plate members 134 on frame 126. Each of these plate members includes a generally planar web portion 136 with mounting flanges 137 extending from the web portion at the sides thereof. The plate members are rounded between fins of the frame, and the web portions of the plate members have a generally trapezoidal shape, with mounting flanges 137 diverging at substantially the same angle as the fins. The plate members are arranged in groups, with the web portion in each group being spaced axially apart and generally parallel to each other. As best seen in FIG. 4, the plate members extending outwardly and downwardly from the core, with the angle of inclination of approximately 45° between the center lines of the plate members and the axis of the core. In the embodiment illustrated, the frame has six radial fins, and the plate members are arranged in six groups, with six plate members in each group. This embodiment has a convenient hexagonal shape in plan view, but any suitable number of fins and plates can be employed.

The plate members are secured to the radial fins of the frame by readily releasable fasteners such as screws 138 and nuts 139, with indium gaskets 141 between the fins and mounting flanges to assure intimate thermal contact between the fins and plate members. Plate members 134 provide the pumping surfaces for the second stage of the pump.

In one embodiment, the plate members are fabricated of copper with a coating of reticulated vitreous carbon on the inner or lower surfaces 142 of the plate members. The upper or outer surfaces 143 of the plate members are highly polished, as by nickel plating to be reflective to radiation.

In one method of manufacture, the coating of reticulated vitreous carbon is formed on the inner or lower surfaces of the plate members before the plate members are mounted on the frame. Once the plate members have been coated, they are positioned between the fins and individually secured by screws 138 and nuts 139. The assembled second stage is then placed on the second stage of the expander and secured by screws 131. In the event that the reticulated vitreous carbon should become contaminated in use or otherwise require replacement, plate numbers 134 can easily be removed and replaced.

A louvered thermal shield 144 is included in the first stage of the pump and mounted above the second stage to prevent external thermal radiation from falling directly on that stage and yet permit passage of all gas which can only be pumped on the colder second stage. The shield includes a central plate 147, a plurality of radial arms 148 extending from the plate to the side wall 121 of the first pumping stage. The inner ends of the radial arms are secured to the central plate by brazing, and the outer ends of the arms are secured to the wall by brackets 149, 151. Brackets 149 are fixed to the radial arms by rivets 152 and brazing, and brackets 151 are fixed to the first wall 121 by screws 153. The brackets are secured together by screws 154. To provide good thermal intimacy, indium foil is sandwiched between the brackets 151 and the first stage wall 121 in between brackets 151 and brackets 149. Outwardly and downwardly inclined louvers or baffles 156 extend between adjacent ones of arms 148 in an overlapping pattern so that thermal radiation from the chamber to be evacuated cannot fall directly on the second stage of the pump. The louvers are fixed to the radial arms by rivets 157 and brazing. In the embodiment illustrated, with the hexagonal second stage, the louvered thermal shield has six sections with four louvers in each section, and the surfaces of the shield are blackened to prevent reflections of thermal radiation to the second stage of the pump. Being a part of the first stage 121, the louvered thermal shield 144 is maintained at substantially the same temperature as the remainder of that stage. Additional details relating to the construction of the pumping apparatus of FIG. 1 are disclosed in U.S. Pat. No. 4,295,338, issued Oct. 10, 1981.

Operation and use of the apparatus is as follows: A chamber to be evacuated is connected in gaseous communication with the inlet opening of the pump and the compressor connected to expander 14 is actuated to maintain the first pumping stage at the temperature and the order of 50° K.–80° K. In the second pumping stage at temperature of the order of 10° K.–20° K. Gases such as water vapor and carbon dioxide condense on the pumping surface formed by the first stage wall 121 and the louvered thermal shield 144 of the first stage. Gases such as helium, hydrogen and neon have relatively unrestricted access into the reticulated vitreous carbon coating on the inner or lower surfaces of plate members 134, where they are pumped by absorption while gases such as oxygen, nitrogen and argon are pumped on all second stage surfaces by condensation. The louvered thermal shield 144 permits relatively unimpeded flow of gaseous species from the inlet opening to the second stage while preventing external thermal radiation for falling directly on the second stage.

A cryosorption pump using reticulated vitreous carbon in absorption panels in a second stage has several advantages. The carbon shape can be made with any geometry so the bonding surface will closely match that of the panel. The adherence problems associated with bonding many irregular sorbent problems are eliminated. The sorbent layer thickness is not limited by particle size. Any thickness of carbon block can be used up to that which prevents access of gas flow to innermost pores, allowing greater gas capacity per unit panel area. Practical thickness range from a lower limit where the material is too fragile to handle, about a sixteenth inch, to an upper limit of about a quarter inch where cryosorption surfaces would be touching each other in some embodiments of the pump. The bulk density of the carbon can be varied over a much greater range than that for activated charcoal, allowing greater gas capacity per unit panel area. Porosities are available in the range of 10000 to 20,000 square meters per gram.

The reticulated vitreous carbon can be formed as a foamed-to-shape piece, or cut in a series of segments. Attachment to the pump is made with clamps, brazing, or any suitable low-temperature adhesive. Segments have the advantage that stress from differential thermal contraction which may detach bonded panels can be avoided. Reticulated vitreous carbon can be cut into suitable segments by forcing a block past a tensioned wire or by sawing with a wood or metal saw. The reticulated vitreous carbon panels being rigid can be clamped to the pump in various embodiments, thereby completely avoiding potential problems associated with organic adhesives.

Figure 7:
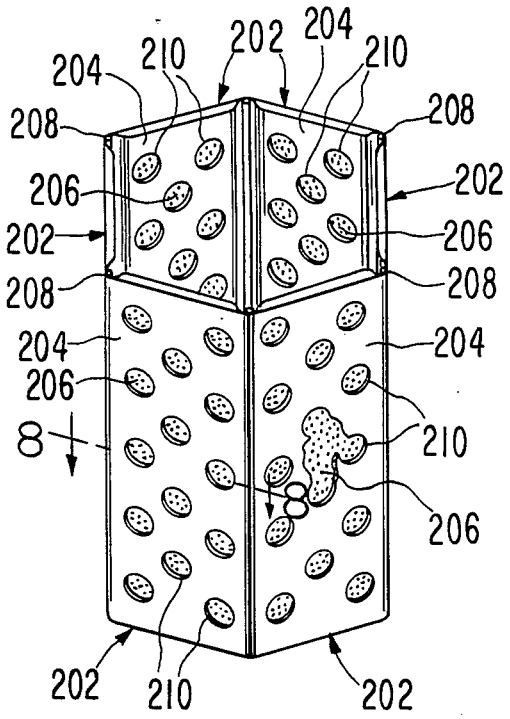
FIG. 7 is a perspective view of an inner cylindrical cryosorption surface of the embodiment of FIGS. 1-3.
Figure 8:
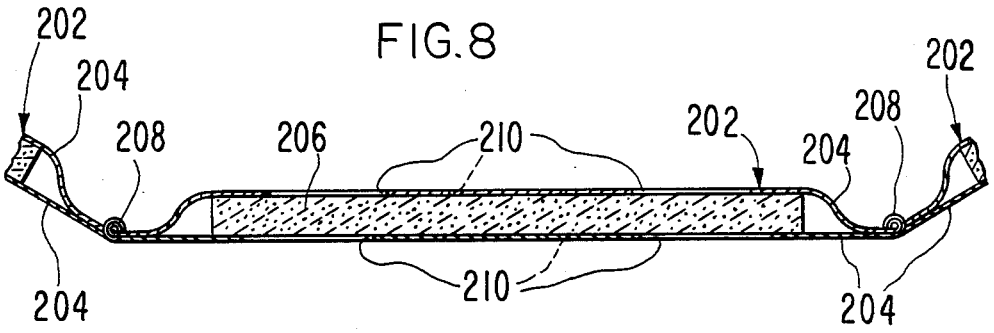
FIG. 8 is a sectional view through the pumping surface of FIG. 7 along the sectional lines 8—8.

In FIGS. 7–8, there is shown a particularly preferred embodiment of cylindrical inner wall 38, in this case formed as a hexagonal cylinder. Segments 202 can be formed of two sheets of metal 204 holding therebetween a panel of reticulated vitreous carbon 206. The edges of the segments 202 can be folding and crimping into seals 208. Apertures 210 in the sheets 204 provide exposure of the reticulated vitreous carbon to the gases to be pumped. If the reticulated vitreous carbon is attached to the second stage without using epoxy, as in this embodiment, regeneration time can be shortened. Purge gas with a temperature of 200° C. can be used. In this embodiment, the second stage is bakeable.

It is apparent from the foregoing that a new and improved cryogenic pump has been provided. While only certain presently preferred embodiments have been decribed in detail, as will be apparent to those familiar with the art, certain changes and modifications can be made without departing from the scope of the invention as defined by the following claims.

What is claimed is:

1. A cryogenic pump for removing gaseous species from a chamber, comprising:

a first stage having an inlet opening at one end thereof for gaseous communication with the chamber and a generally cylindrical pumping surface maintained at a first temperature for removing a portion of the gaseous species, a second stage positioned coaxially within the first stage and having a pumping surface maintained at a temperature lower than the first temperature for removing an additional portion of the gaseous species, and a plurality of baffle members spaced axially apart between the first and second stages for shielding the pumping surface of the second stage from direct exposure to the inlet opening while permitting substantially unimpeded flow of the gaseous species from the inlet opening to the second stage, said second stage including surfaces of reticulated vitreous carbon.

2. A cryogenic pump as in claim 1 wherein said surfaces of reticulated vitreous carbon are formed by attaching segments of reticulated vitreous carbon panels on metal surfaces of said second stage.

3. A cryogenic pump as in claim 2 wherein said reticulated vitreous carbon panels are attached with low-temperature epoxy adhesive.

4. A cryogenic pump as in claim 1 wherein said surfaces of reticulated vitreous carbon are formed between two sheets of metal, said two sheets of metal having large perforations therein whereby to expose said surfaces of reticulated vitreous carbon to the gaseous species being removed.

5. A cryogenic pump as in claim 1 wherein the pumping surface of the first stage is blackened to prevent reflection of thermal energy from the inlet opening to the pumping surface of the second stage.

6. A cryogenic pump as in claim 1 wherein the baffle members include a first baffle member having a generally planar portion positioned axially between the inlet opening and the second stage and a frusto-conical portion extending outwardly from the generally planar portion and away from the inlet opening, and a second baffle positioned radially adjacent said second stage and having a frusto-conical wall of larger diameter than the frusto-conical portion of the first baffle member.

7. A cryogenic pump as in claim 3 wherein the baffle members include radially extending annular plates.

8. A cryogenic pump as in claim 3 wherein the first stage comprises a ring adjacent the inlet opening, a support plate at the end of the stage opposite the inlet opening, and a plurality of individual leaves extending between the ring and plate to form the generally cylindrical pumping surface.

9. A cryogenic pump as in claim 8 wherein the leaves are formed to provide a radial bulge for increased gas flow in the vicinity of said second stage.

10. A cryogenic pump as in claim 3 wherein the baffle members are maintained at substantially the temperature of said first stage.

11. A cryogenic pump for removing gaseous species from a chamber, comprising a first stage having an inlet opening at one end thereof for gaseous communication with the chamber and a generally cylindrical pumping surface maintained at a first temperature for removing a portion of the gaseous species, a second stage positioned coaxially within the first stage and having a pumping surface maintained at a temperature lower than the first temperature for removing an additional portion of the gaseous species, the pumping surface of the first stage being blackened to prevent reflection of thermal energy from the inlet opening to the pumping surface of the second stage, a first baffle having a first portion positioned axially between the inlet opening and the second stage and a frusto-conical portion extending outwardly from the first portion and away from the inlet opening and second baffle member of frusto-conical shape positioned radially adjacent the second stage and having a greater diameter than the frusto-conical portion of the first baffle member, said baffle members being maintained at substantially the temperature of the first stage and shielding the pumping surface of the second stage from direct exposure to the inlet opening while permitting substantially unimpeded flow of the gaseous species from the inlet opening to the second stage, said second stage including surfaces of reticulated vitreous carbon.

12. A cryogenic pumping apparatus having pumping surfaces maintained at a predetermined temperature for condensation and adsorption of gaseous species, comprising: a frame having an axially extending core portion and a plurality of fins extending radially from the core portion, a group of axially spaced generally parallel plate members extending outwardly from the core portion between adjacent ones of the fins and inclined at a predetermined angle to the axis of the core portion, a surface of reticulated vitreous carbon formed on at least one surface of each of the plate members, and removable fasteners securing the plate members to the fins.

13. A cryogenic pump as in claim 12 wherein said surfaces of reticulated vitreous carbon are formed by attaching segments of reticulated vitreous carbon panels on metal surfaces of said second stage.

14. A cryogenic pump as in claim 13 wherein said reticulated vitreous carbon panels are attached with low-temperature epoxy adhesive.

15. A cryogenic pump as in claim 12 wherein said surfaces of reticulated vitreous carbon are formed between two sheets of metal, said two sheets of metal having large perforations therein whereby to expose said surfaces of reticulated vitreous carbon to the gaseous species being removed.

16. The apparatus of claim 12 wherein the plate members have generally planar web portions with mounting portions at the sides of the web portions adjacent the radial fins of the frame.

17. Cryogenic pumping apparatus for removing gaseous species from a chamber, comprising: means forming an inlet opening for gaseous communications with the chamber, a first stage extending axially from the inlet opening and having a pumping surface maintained at a first temperature for removing a portion of the gaseous species, and a second stage positioned coaxially within the first stage and having a plurality of pumping surfaces maintained at a temperature lower than the first temperature for removing an additional portion of the gaseous species, said first stage including a louvered thermal shield positioned between the inlet opening and the second stage for preventing thermal radiation from the chamber from falling directly on the pumping surfaces of the second stage while permitting relatively unimpeded flow of gaseous species from the inlet opening to the second stage, said second stage comprising a frame having an axially extending core portion and a plurality of fins extending radially from the core portion, a plurality of axially spaced generally parallel plate members extending outwardly from the core portion and extending away from the inlet opening and extending between adjacent ones of the fins, a surface of reticulated vitreous carbon formed on at least one surface of each of the plate members, and removable fasteners securing the plate members to the fins.

18. A cryogenic pumping apparatus as in claim 17 wherein said surfaces of reticulated vitreous carbon are formed by attaching segments of reticulated vitreous carbon panels on metal surfaces of said second stage.

19. A cryogenic pumping apparatus as in claim 17 wherein said surfaces of reticulated vitreous carbon are formed between two sheets of metal, said two sheets of metal having large perforations therein whereby to expose said surfaces of reticulated vitreous carbon to the gaseous species being removed.

20. A cryogenic pumping apparatus for removing gaseous species from a chamber, comprising: means forming an inlet opening for gaseous communication with the chamber, a first stage extending from the inlet opening and having a pumping surface maintained at a first temperature for removing a portion of the gaseous species, and a second stage positioned within the first stage and maintained at a temperature lower than the first temperature for removing an additional portion of the gaseous species, said first stage including a thermal shield means positioned between the inlet opening and the second stage for preventing thermal radiation from the chamber from falling directly on the second stage while permitting relatively unimpeded flow of gaseous species from the inlet opening to the second stage, said second stage comprising a frame having an axially extending core portion and a plurality of fins extending radially from the core portion, a plurality of individual plate members removably mounted on the frame to form pumping surfaces for the gaseous species, said plate members being axially spaced and generally parallel, and said plate members extending outwardly from the core portion and extending between adjacent ones of the fins, a surface of reticulated vitreous carbon formed on at least one surface of each of the plate members, said plate members being generally planar web portions with mounting portions at the sides of the web portions adjacent the radial fins of the frame, and removable fasteners securing the plate members to the fins.

* * * * *